US008146205B2

(12) United States Patent
Conner et al.

(10) Patent No.: US 8,146,205 B2
(45) Date of Patent: Apr. 3, 2012

(54) TAMPER RESISTANT HINGE

(75) Inventors: Patrick A. Conner, Elkhart, IN (US); Robert I. Chidister, Osceola, IN (US)

(73) Assignee: Imperial Stamping Corporation, Elkhart, IN (US)

( * ) Notice: Subject to any disclaimer, the term of this patent is extended or adjusted under 35 U.S.C. 154(b) by 377 days.

(21) Appl. No.: 12/425,807

(22) Filed: Apr. 17, 2009

(65) Prior Publication Data

US 2009/0260185 A1 Oct. 22, 2009

Related U.S. Application Data

(60) Provisional application No. 61/046,997, filed on Apr. 22, 2008.

(51) Int. Cl.
*E05D 11/00* (2006.01)

(52) U.S. Cl. ..... 16/250; 16/387; 16/389

(58) Field of Classification Search ..... 16/250, 16/251, 387, 389, 380; 292/285, 259 R, 292/281, 286, DIG. 32, DIG. 71, 283
See application file for complete search history.

(56) References Cited

U.S. PATENT DOCUMENTS

| | | | | | |
|---|---|---|---|---|---|
| 721,045 | A | | 2/1903 | Keller | |
| 722,344 | A | | 3/1903 | Wirt | |
| 1,389,450 | A | | 8/1921 | Kules | |
| 2,169,059 | A | | 8/1939 | Soss et al. | |
| 2,183,834 | A | | 12/1939 | Ferris | |
| 2,315,488 | A | * | 4/1943 | Aldeen | 16/380 |
| 2,739,342 | A | * | 3/1956 | Pickett | 16/389 |
| D183,261 | S | | 7/1958 | Mink | |
| 3,370,877 | A | | 2/1968 | Hallberg | |
| 3,591,247 | A | * | 7/1971 | Berry et al. | 16/389 |
| 4,079,974 | A | * | 3/1978 | Roper | 292/281 |
| 4,397,488 | A | | 8/1983 | Pastva | |
| 4,761,852 | A | | 8/1988 | Sauber | |
| 5,462,320 | A | | 10/1995 | Davis | |
| 5,562,316 | A | | 10/1996 | Bullock et al. | |
| 6,854,775 | B2 | | 2/2005 | Senn | |
| 6,860,530 | B2 | | 3/2005 | Senn | |
| 2009/0250950 | A1 | * | 10/2009 | Jeffries | 292/259 R |

* cited by examiner

*Primary Examiner* — Victor Batson
*Assistant Examiner* — Jeffrey O Brien
(74) *Attorney, Agent, or Firm* — Gardner, Linn, Burkhart & Flory, LLP

(57) ABSTRACT

A hinge assembly incorporates an anti-tamper member that is selectively positionable to protect fasteners holding the hinge assembly to a mounting surface such as an access door. The hinge assembly may be incorporated into a bar lock assembly to provide additional tamper resistance for a shipping container, for example, to limit or prevent unauthorized access to the container.

9 Claims, 3 Drawing Sheets

TAMPER RESISTANT HINGE

CROSS REFERENCE TO RELATED APPLICATION

The present application claims the benefit of U.S. provisional application Ser. No. 61/046,997, filed Apr. 22, 2008, which is hereby incorporated herein by reference in its entirety.

FIELD OF THE INVENTION

The present invention relates generally to hinges and, more particularly, to hinges used on container doors and the like.

BACKGROUND OF THE INVENTION

Access doors for containers, such as shipping containers, semitrailers, and the like, are typically hinged at one side and secured via a bar lock. The bar lock is typically pivotally mounted opposite the door hinges and is positionable between an open or unlocked position, and a closed or locked position. In the locked position, the bar lock is typically held in position by a shackle, a seal, a padlock, or the like. However, the hinges to which the bar lock is pivotally mounted may have fasteners, such as screws or bolts, that are readily accessible and/or removable, such that the bar lock may be defeated by removing the hinges rather than tampering with the shackle, seal, or padlock.

SUMMARY OF THE INVENTION

The present invention provides an anti-tamper member or plate that is fixedly attached to a hinge, such as the hinge of a bar lock system, in order to prevent access to the fasteners of the hinge when the bar lock is in a closed or locked position. The anti-tamper member substantially covers the fasteners of the hinge in order to discourage or prevent access to the hinge fasteners, thus improving the security of the bar lock.

According to one form of the present invention, the tamper resistant hinge includes a hinge plate, at least one fastener, and an anti-tamper member. The fasteners couple the hinge plate to a mounting surface, such as a door or a wall. The anti-tamper member substantially covers and protects the fasteners in order to inhibit access to the fasteners, thereby limiting or substantially preventing removal of the fasteners and the hinge.

According to another form of the present invention, a tamper resistant hinge, such as for a bar lock assembly on a shipping container or trailer, includes a hinge plate, at least one fastener, a hinge pin, a pivot arm, and an anti-tamper member. The hinge plate defines or forms a passageway for receiving the hinge pin, to which the pivot arm is pivotally coupled. The fasteners, which may be screws, bolts, rivets, or the like, couple the hinge plate to a mounting surface such as a door, a panel, or a wall. The pivot arm defines a passageway for receiving the hinge pin and is pivotally coupled to the hinge plate via the hinge pin so that the pivot arm can pivot between an open position and a closed position. The anti-tamper member is fixed to the pivot arm so that the anti-tamper member substantially covers the fasteners when the pivot arm is in the closed position. The anti-tamper plate exposes the fasteners when the pivot arm is moved to the open position.

In one aspect, the anti-tamper member is a substantially rectangular plate, which may have rounded corners or ends. Optionally, the anti-tamper member may have opposite end portions located at opposite ends of a planar main body portion, the opposite end portions being angled with respect to the main body portion. The angled end portions closely cover the fasteners when the pivot arm is moved to the closed position to prevent prying of the anti-tamper member and to further reduce access to the fasteners.

Therefore, the present invention provides a device that limits or prevents access to the fasteners of a hinge in order to prevent or resist tampering with the fasteners and removal of the hinge. Thus, a locked door or a locked bar lock assembly may be provided with additional security by protecting the hinges from tampering or removal.

These and other objects, advantages, purposes, and features of the present invention will become apparent upon review of the following description in conjunction with the drawings.

DESCRIPTION OF THE PREFERRED EMBODIMENTS

Figure 1:
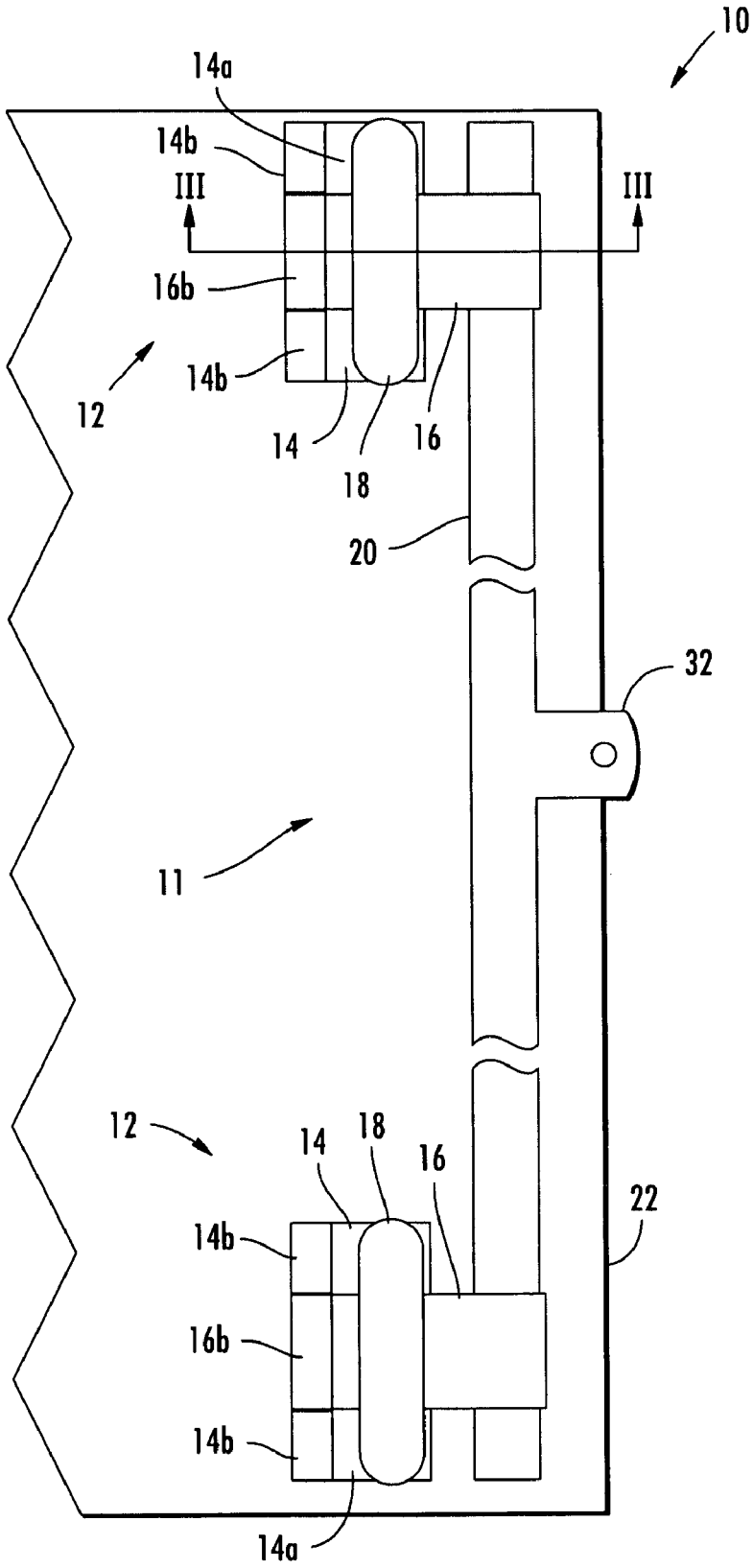
FIG. 1 is a front elevation of a bar lock system including a pair of tamper resistant hinges in accordance with the present invention.

Referring now to the drawings and the illustrative embodiments depicted therein, a tamper resistant system 10 includes a bar lock assembly 11 and a pair of tamper resistant hinge assemblies 12 for securing an access door, such as a trailer or container door or the like. As will be more fully described below, each hinge assembly 12 substantially limits or prevents access to fasteners that hold bar lock assembly 11 to the access door or other mounting surface.

Hinge assembly 12 includes a hinge plate 14, a pivot member 16, and an anti-tamper member 18 (FIGS. 1 and 3-6). Hinge assemblies 12 are coupled together by a lock bar 20 that spans between hinge assemblies 12, which are connected to a mounting surface such as a door 22. Pivot member 16 is pivotally connected to hinge assembly 12 so that lock bar 20 may be moved or pivoted relative to hinge plate 14 and the mounting surface 22.

Figure 3:
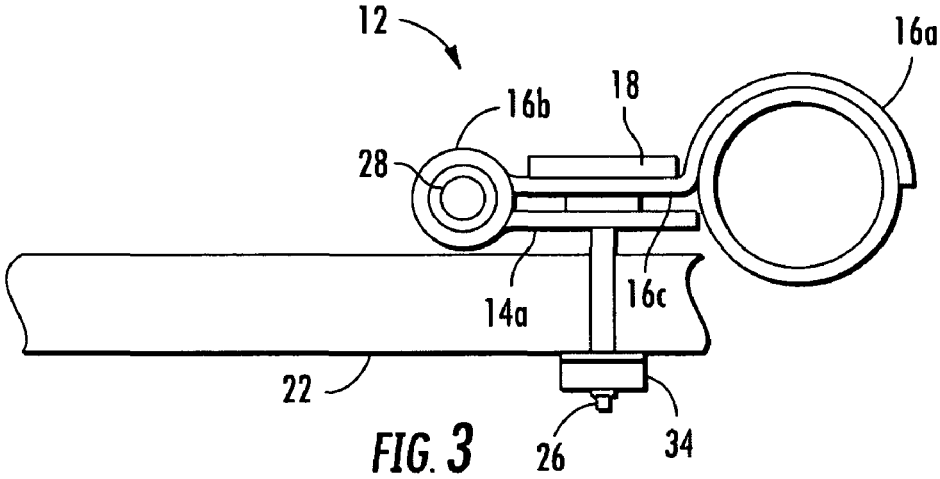
FIG. 3 is an end sectional view of a hinge assembly, taken along the section designated III in FIG. 1.

Hinge plate 14 includes a generally planar portion 14*a* that is positioned at or near door 22 (FIGS. 1 and 3). Planar portion 14*a* includes a pair of holes or passageways 24 (FIG. 5) for receiving fasteners 26 therethrough (FIG. 3). A pair of tangs 14*b* project from planar portion 14*a* of hinge plate 14 and are curved to form substantially circular passageways for receiving a hinge pin 28. Hinge plate 14 is mounted to mounting surface 22 via fasteners 26. Fasteners 26 may be threaded screws, bolts, rivets, or the like, and may be fastened to mounting surface 22 with a receiving member 34, such as a threaded nut.

Pivot member 16 includes a curved lock bar engaging portion 16*a*, a substantially round or circular hinge pin engaging portion 16*b*, and a substantially flat planar portion 16*c* located between and connecting the bar engaging portion 16*a* and the hinge pin engaging portion 16*b*. Bar engaging portion

16*a* has a radius of curvature substantially conforming to that of lock bar 20, and may be fixed to the lock bar 20, such as by welding or with fasteners. Hinge pin engaging portion 16*b* is positioned between hinge plate tangs 14*b* so that the passageway defined by hinge pin engaging portion 16*b* is aligned and substantially coaxial with the passageways defined by tangs 14*b*. Optionally, lock bar 20 may be rotatably mounted to pivot member 16, as may be desirable in certain applications, without departing from the spirit and scope of the present invention.

Figure 4:
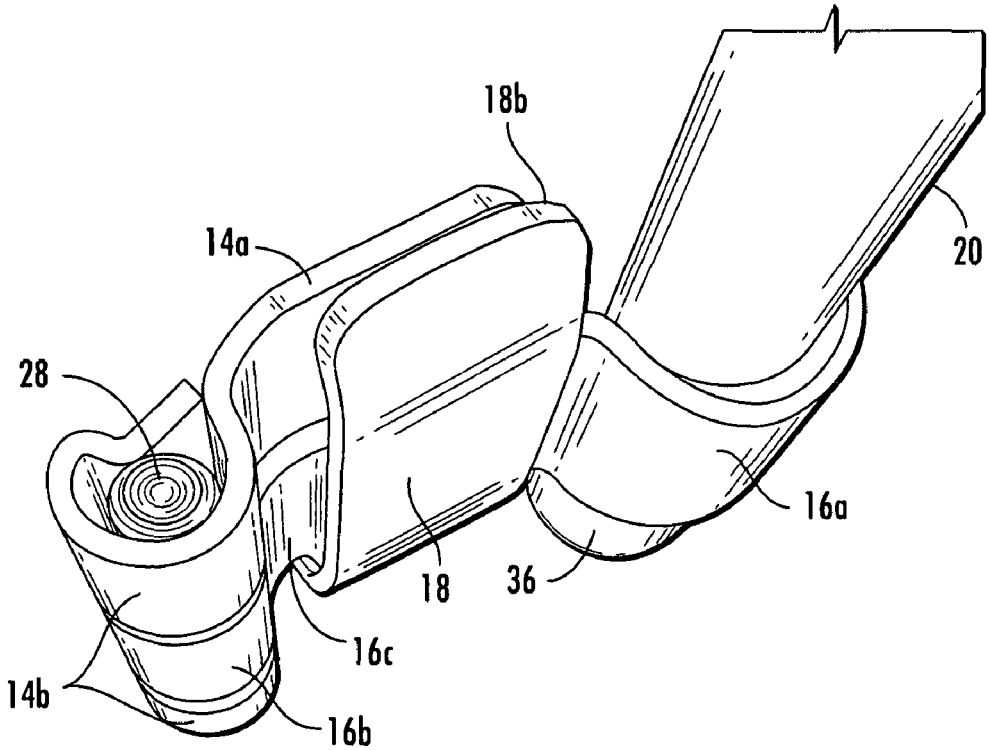
FIG. 4 is a top perspective view of a hinge assembly in accordance with the present invention.
Figure 5:
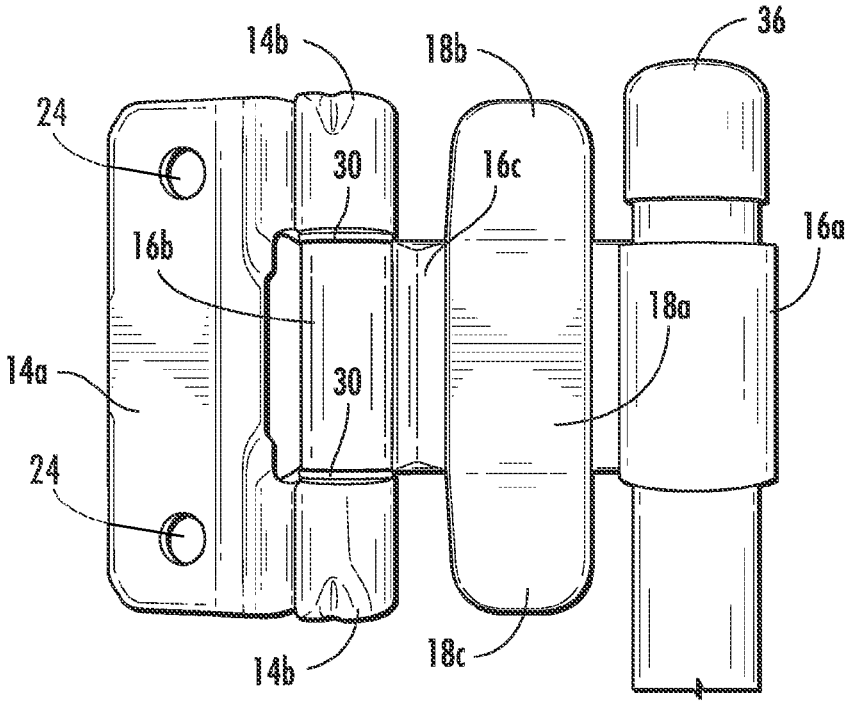
FIG. 5 is a rear view of the hinge assembly of FIG. 4, in an open position.

Hinge pin 28 is installed in passageways of hinge plate tangs 14*b* and hinge pin engaging portion 16*b* of pivot member 16 so that pivot member 16 is pivotally mounted or coupled to hinge plate 14. As shown in FIGS. 4 and 5, hinge plate tangs 14*b* may be crimped at their outer portions to preclude or substantially prevent the unauthorized removal of hinge pin 28. Bushings 30 (FIGS. 5 and 6) may be positioned on either side of hinge pin engaging portion 16*b* and around hinge pin 28 to prevent undue wear, binding, noise, and unauthorized access to hinge pin 28 through gaps between hinge pin engaging portion 16*b* and hinge plate tangs 14*b*. When pivot member 16 is at a closed position (FIGS. 3, 4, and 6), planar portion 16*c* is adjacent and substantially parallel to hinge plate planar portion 14*a*. When pivot member 16 is moved to an open position (FIG. 5), bar engaging portion 16*a* and planar portion 16*c* extend outwardly away from hinge plate tangs 14*b* and generally away from planar portion 14*a* of hinge plate 14.

Figure 2:
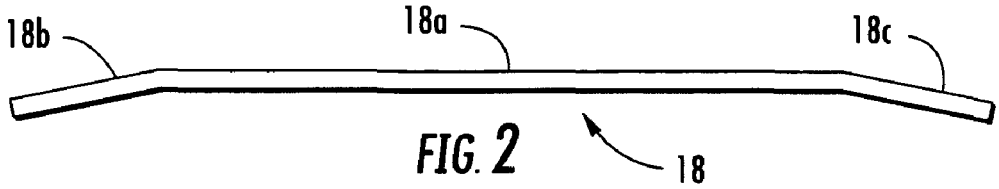
FIG. 2 is a side elevation of an anti-tamper member.
Figure 6:
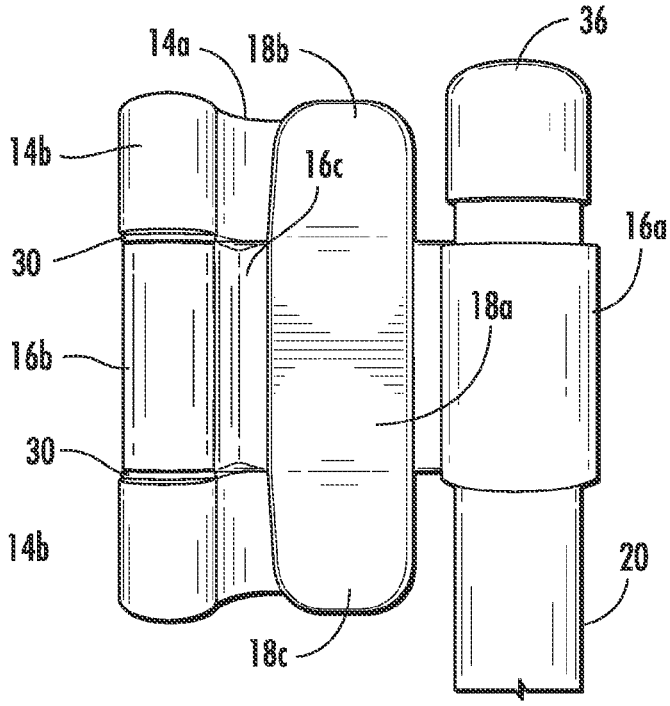
FIG. 6 is a front view of the hinge assembly of FIG. 4, in a closed position.

Anti-tamper member 18 is coupled to planar portion 16*c* of pivot member 16 and pivots with pivot member 16 relative to hinge plate 14. Anti-tamper member 18 has a generally planar main body portion 18*a* and opposite end portions 18*b*, 18*c* extending outwardly from main body portion 18*a* (FIG. 2). Anti-tamper member 18 is coupled to pivot member 16 at main body portion 18*a*, which may be welded or fastened to planar portion 16*c* of pivot member 16. End portions 18*b*, 18*c* of anti-tamper member 18 thus extend outwardly beyond planar portion 16*c* of pivot member 16 and substantially cover and guard fasteners 26 and portions of hinge plate planar portion 14*a* when pivot member 16 is in the closed position (FIGS. 4 and 6). When pivot member 16 is in the open position (FIG. 5), anti-tamper member 18 is positioned away from hinge plate 14, thus permitting access to hinge plate 14 and fasteners 26.

Optionally, anti-tamper member end portions 18*b*, 18*c* are angled relative to main body portion 18*a* to reduce the size of any gap that may exist between anti-tamper member 18 and hinge plate planar portion 14*a* when pivot member 16 is in the closed position (FIG. 4). For example, anti-tamper member end portions 18*b*, 18*c* may be angled at about fifteen degrees in order to reduce access to fasteners 26. Thus, anti-tamper member 18 limits or substantially precludes the use of a pry bar or other tool to access fasteners 26 when pivot member 16 is in the closed position. Anti-tamper member 18 is generally rectangular in shape, and may have rounded corners and/or rounded ends to improve the aesthetics and safety of hinge assembly 12. Optionally, anti-tamper member 18 may be incorporated into pivot member 16 or unitarily formed therewith, without departing from the spirit and scope of the present invention. For example, the pivot member may be stamped or formed from sheet metal with wings or projections similar to end portions 18*b*, 18*c* of anti-tamper member 18, with the main body portion 18*a* replaced by the pivot member itself.

Pivot member 16 is selectively held in the closed position by lock bar 20, which includes a locking portion 32 that is engaged by a seal (such as a strap-type seal), a latch, a shackle, a lock (such as a padlock), or the like. Pivot member 16 is thus positionable relative to hinge plate 14 by grasping lock bar 20 and pushing or pulling the lock bar to reposition pivot member 16. When pivot member 16 and lock bar 20 are in their closed position, lock bar 20 may be locked or latched at locking portion 32, thereby preventing further movement of lock bar 20 and pivot member 16 and positioning anti-tamper member 18 to prevent access to fasteners 26. Optionally, end caps 36 may be provided at lock bar 20 to limit or prevent entry of water and debris into lock bar 20, which may be a hollow tubular member, for example.

Hinge assembly 12 is made from any suitably strong, tamper-resistant material, such as high strength steel, stainless steel, high strength aluminum alloy, or the like. Preferably, anti-tamper member 18 is made of sufficiently strong material, such as high strength steel, in order to resist flexing or grinding.

Changes and modifications to the specifically described embodiments may be carried out without departing from the principles of the present invention, which is intended to be limited only by the scope of the appended claims, as interpreted according to the principles of patent law including the doctrine of equivalents.

The embodiments of the invention in which an exclusive property is claimed are defined as follows:

1. A tamper-resistant hinge system for a bar lock assembly, said hinge system comprising:

a hinge plate having a pin-receiving portion and a generally planar portion, said pin-receiving portion defining a passageway along a first side of said hinge plate, and said generally planar portion defining a second side of said hinge plate, opposite said first side;

at least one fastener at said generally planar portion of said hinge plate, said fastener coupling said hinge plate to a mounting surface, and said fastener having a head portion with an outward face directed away from the mounting surface;

a hinge pin disposed in said passageway of said hinge plate;

a pivot arm, said pivot arm having a pin-receiving portion defining a passageway that is substantially coaxial with said passageway of said hinge plate for receiving said hinge pin in said passageways, said pivot arm being pivotally coupled to said hinge plate via said hinge pin and pivotable between an open position and a closed position;

a lock bar coupled to said pivot arm, opposite said pin-receiving portion of said pivot arm, said lock bar being pivotable with said pivot arm between the open position and the closed position, wherein said lock bar is lockable in said closed position to preclude access to the container;

an anti-tamper member extending outwardly from said pivot arm and located between said lock bar and said pin-receiving passageway of said pivot arm, said anti-tamper member having a first side facing said first side of said hinge plate and a second side facing said second side of said hinge plate; and wherein when said pivot arm and said lock bar are in the closed position, said anti-tamper member substantially covers and protects said head portion of said at least one fastener from access to at least said outward face, said pin-receiving portions of said hinge plate and of said pivot arm substantially block access to said head portion from along said first side of said anti-tamper member, and said lock bar substantially blocks access to said head portion from along said second side of said anti-tamper member, and wherein said anti-tamper member is configured to expose said head portion of said at least one fastener when said pivot arm is in said open position.

2. The tamper-resistant hinge of claim 1, wherein said at least one fastener comprises a first fastener spaced from said pivot arm at one side, and a second fastener spaced from said pivot arm at an opposite side, wherein said anti-tamper member is adapted to substantially cover and protect said first fastener and said second fastener when said pivot arm is in said closed position.

3. The tamper-resistant hinge of claim 2, wherein said anti-tamper member comprises a substantially rectangular plate having rounded corners.

4. The tamper-resistant hinge of claim 1, wherein said anti-tamper member comprises:

a substantially rectangular planar main body portion; and opposite end portions, each of said opposite end portions located at an opposite end of said main body portion and angled with respect to said main body portion.

5. The tamper-resistant hinge of claim 4, wherein each of said opposite end portions is angled at approximately 15 degrees relative to said main body portion.

6. A tamper-resistant system for a container, said system comprising:

a hinge assembly comprising:

a hinge pin;

a hinge plate having a pin-receiving portion along a proximal side portion of said hinge plate and a generally planar portion defining a distal side portion of said hinge plate, opposite said proximal side portion, said generally planar portion defining at least one hole for receiving a fastener, said hole having a perimeter region;

a pivot arm having a proximal side portion and a distal side portion, said proximal side portion of said pivot arm having a pin-receiving portion that cooperates with said pin-receiving portion of said hinge plate to define a pin-receiving passageway, said pivot arm being coupled to said hinge plate via said hinge pin in said pin-receiving passageway, wherein said pivot arm is pivotable relative to said hinge plate and a mounting surface of the container, between an open position in which said pivot arm is angled away from said hinge plate and a closed position in which said pivot arm is positioned adjacent said hinge plate;

a lock bar for securing an access door of the container, said lock bar being coupled to said distal side portion of said pivot arm and pivotable between the open position and the closed position, wherein said lock bar is lockable in said closed position to preclude access to the container; and an anti-tamper member extending outwardly from said pivot arm and located between said lock bar and said pin-receiving portion of said pivot arm;

wherein when said pivot arm and said lock bar are in the closed position, said anti-tamper member substantially covers and protects from access said hole in said generally planar portion of said hinge plate and any fastener received therein for securing said hinge plate to the mounting surface of the container, said pin-receiving portions of said hinge plate and of said pivot arm substantially block access to a proximal-facing portion of said perimeter region of said hole in said generally planar portion of said hinge plate and any fastener received therein for securing said hinge plate to the mounting surface of the container, and said lock bar substantially blocks access to a distal-facing portion of said perimeter region of said hole in said generally planar portion of said hinge plate and any fastener received therein for securing said hinge plate to the mounting surface of the container, and wherein said anti-tamper member is configured to expose said hole in said generally planar portion of said hinge plate and any fastener received therein for securing said hinge plate to the mounting surface of the container when said pivot arm is in said open position.

7. The tamper-resistant system of claim 6, wherein said anti-tamper member comprises:

a substantially rectangular planar main body portion; and opposite end portions, each of said opposite end portions located at an opposite end of said main body portion and angled with respect to said main body portion.

8. The tamper-resistant system of claim 7,wherein each of said opposite end portions is angled at approximately 15 degrees relative to said main body portion.

9. The tamper-resistant system of claim 6, wherein said system comprises a pair of said hinge assemblies and at least two fasteners at each of said hinge assemblies, said lock bar coupling said hinge assemblies to one another.

* * * * *